US008821178B2

(12) United States Patent
Fukui et al.

(10) Patent No.: US 8,821,178 B2
(45) Date of Patent: Sep. 2, 2014

(54) CONNECTOR

(71) Applicant: Molex Incorporated, Lisle, IL (US)

(72) Inventors: Keiko Fukui, Yamato (JP); Toshihiro Niitsu, Machida (JP)

(73) Assignee: Molex Incorporated, Lisle, IL (US)

( * ) Notice: Subject to any disclaimer, the term of this patent is extended or adjusted under 35 U.S.C. 154(b) by 4 days.

(21) Appl. No.: 13/771,213

(22) Filed: Feb. 20, 2013

(65) Prior Publication Data

US 2014/0057497 A1 Feb. 27, 2014

(30) Foreign Application Priority Data

Feb. 20, 2012 (JP) ..... 2012-034446

(51) Int. Cl.
*H01R 4/50* (2006.01)

(52) U.S. Cl.
USPC ..... 439/342; 439/862

(58) Field of Classification Search
USPC ..... 439/342, 660, 856, 857, 862
See application file for complete search history.

(56) References Cited

U.S. PATENT DOCUMENTS 8,277,230 B2 * 10/2012 Huo et al. ..... 439/66
8,342,873 B2 * 1/2013 Liao et al. ..... 439/342
8,636,535 B1 * 1/2014 Gattuso ..... 439/342

FOREIGN PATENT DOCUMENTS

JP 2008-270100 11/2008

* cited by examiner

*Primary Examiner* — Khiem Nguyen
(74) *Attorney, Agent, or Firm* — Timothy M. Morella

(57) ABSTRACT

A connector, in which each conductive pattern includes a plate-like terminal engaging a protruding terminal on the other connector. The plate-like terminal includes a protruding terminal receiving opening for receiving the protruding terminal, a beam-like first terminal member positioned to the side of the protruding terminal receiving opening, and a first contact portion formed in the first terminal member. The first terminal member generates spring force towards the center of the connector in the lateral direction when the protruding terminal received inside the protruding terminal receiving opening moves relative to the first contact portion.

18 Claims, 11 Drawing Sheets

FIG. 2A
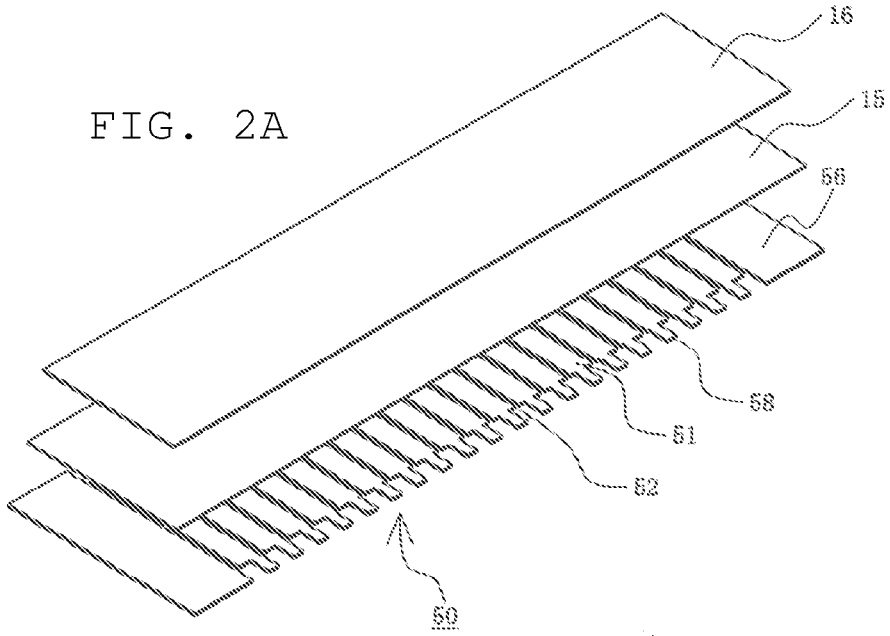
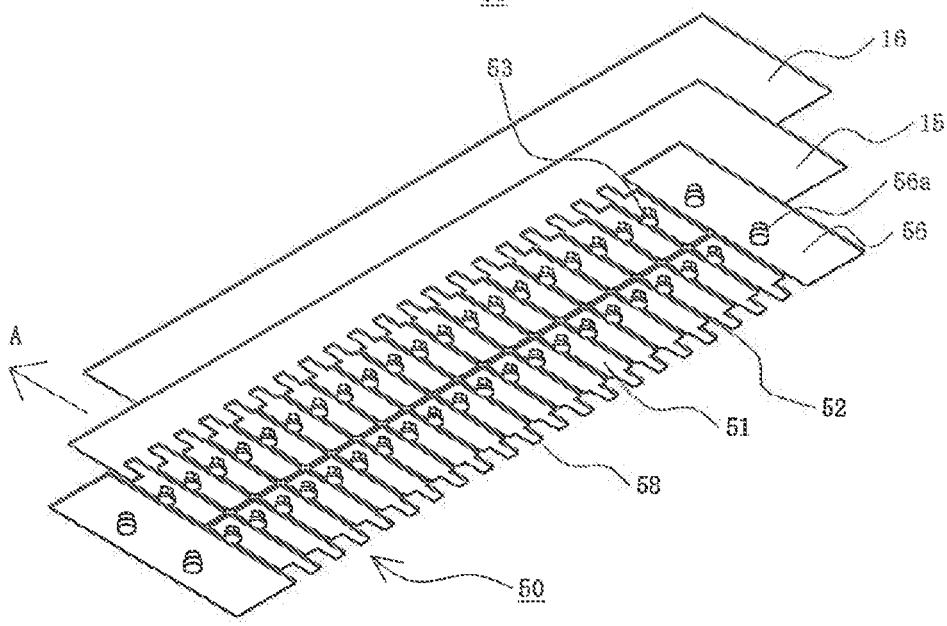
FIG. 2B

FIG. 11A
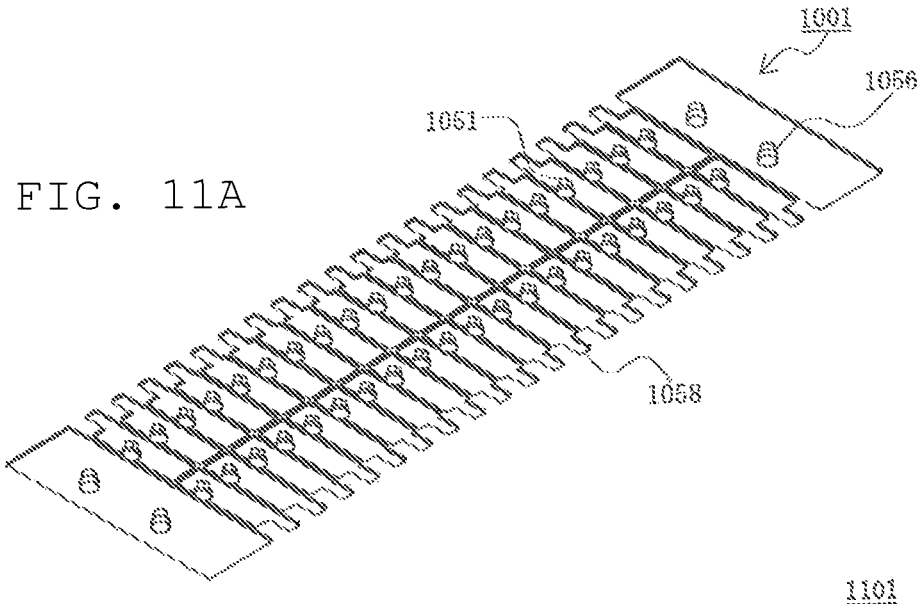
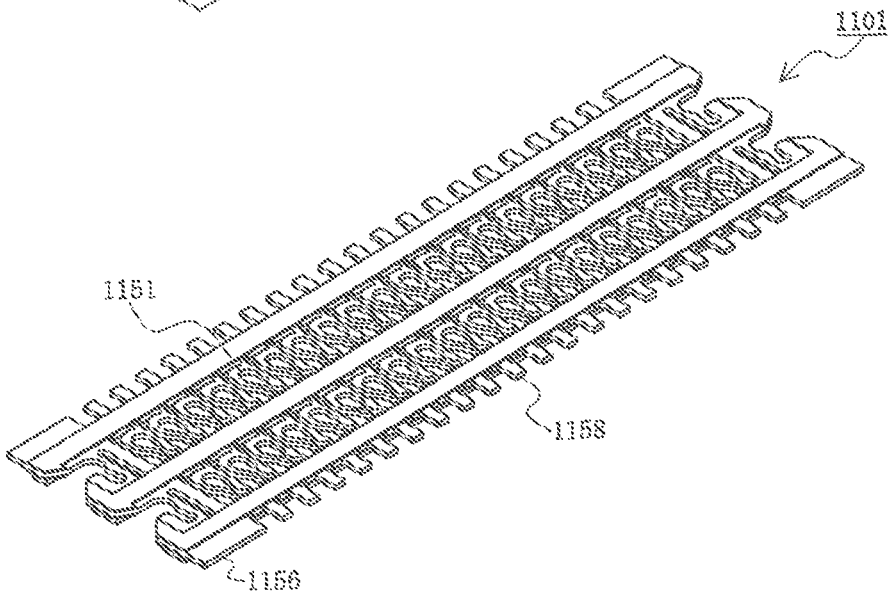
FIG. 11B
PRIOR ART

CONNECTOR

REFERENCE TO RELATED APPLICATIONS

The Present Disclosure claims priority to prior-filed Japanese Patent Application No. 2011-034446, entitled "Connector," filed on 20 Feb. 2012 with the Japanese Patent Office. The content of the aforementioned patent application is incorporated in its entirety herein.

BACKGROUND OF THE PRESENT DISCLOSURE

The Present Disclosure relates, generally, to a connector, and, more particularly, to a connector in which a first terminal member of a plate-like terminal engaging a protruding terminal generates spring force towards the center of the connector in the lateral direction and applies pressure to the protruding terminal such that there is no possibility of adjacent plate-like terminals contacting each other even when the plate-like terminals have a narrow pitch; such that stable contact can be maintained between protruding terminals and plate-like terminals; and such that brief interruptions can be reliably prevented.

In electronic devices, there is an increasing demand for more compact and more integrated connectors to keep pace with the miniaturization and improved performance of these devices and their components. Conventional connectors have been proposed in which a plurality of conductive patterns are formed on an insulating film, and the end portions of these conductive patterns are connected to another board. An example of such a connector is disclosed in Japanese Patent Application No. 2007-114710, the content of which is incorporated by reference in its entirety herein.

FIG. 10 illustrates a top view of a conventional connector. In FIG. 10, 911 is a female-side base serving as the base of a female connector, mounted on the surface of a circuit board (not shown). A terminal receiving opening 954 is formed in the female-side base 911 and passes through to both surfaces of the female-side base 911. A plurality of female-side electrode patterns 951 are arranged in the lateral direction at a predetermined interval inside the terminal receiving opening 954.

Each female-side electrode pattern 951 has a tail portion 958 extending towards the outside of the female-side base 911, and a tail portion 958 is connected electrically to each conductive trace in an electric circuit formed on the surface of the circuit board. Also, each female-side electrode pattern 951 has an inner opening 954*a* and an arm portion 953 defining the perimeter of the inner opening 954*a*. The inner opening 954*a* has a narrow portion and a wide portion formed near both ends of the narrow portion.

In the initial stage of the mating operation, the male connector (not shown) is moved towards the female connector in the thickness direction of the female connector (perpendicular to the surface of the Figure), and the connectors are mated. At this time, a bump-like male-side electrode protrusion (not shown) which protrudes from the surface of the male connector is inserted into a wide portion of the inner opening 954*a*. Next, when the male connector is moved relative to the female connector in the vertical direction in the drawing, the male-side electrode protrusion moves into the narrow portion. This completes the mating of the male connector and the female connector.

In this instance, the male-side electrode protrusion has a diameter greater than the width of the narrow portion, but somewhat smaller than the inner diameter of the wide portion.

Therefore, in the initial stage of the mating operation for the male connector and the female connector, the male-side electrode protrusion is smoothly inserted into the inner opening 954*a* of the female-side electrode pattern 951. When the male-side electrode protrusion moves into the narrow portion, the space in the arm portion 953 is pushed apart by the male-side electrode protrusion, and the male-side electrode protrusion is pinched from both sides by the arm portion 953. Therefore, when the mating of the male connector and the female connector is completed, the male-side electrode protrusion and the female-side electrode pattern 951 reliably contact each other and establish an electrical connection.

FIG. 11 is a perspective view of another conventional connector, in which FIG. 11(*a*) shows the male connector 1001 and FIG. 11(*b*) shows the female connector 1101. In FIG. 11(*a*), 1001 is a male connector mounted on the surface of a board (not shown). The male connector 1001 has protruding terminals 1051 and reinforcing brackets 1056. The tail portions 1058 of the protruding terminals 1051 are connected by solder to a circuit on the board (not shown), and the reinforcing brackets 1056 are fixed by solder to the surface of the board. In FIG. 11(*b*), 1101 is a female connector mounted on the surface of a board (not shown). The connector 1101 has resilient terminals 1151 and reinforcing brackets 1156. The tail portions 1158 of the resilient terminals 1151 are connected by solder to a circuit on the board (not shown), and the reinforcing brackets 1156 are fixed by solder to the surface of the board. Also, the spring force of the resilient terminals 1151 is biased to one side in the lateral direction of the female connector 1101 (upward and to the right in FIG. 11(*b*)). Therefore, when the mating of the male connector and the female connector is completed, the resilient terminals bias the protruding terminals to one side to reliably establish contact and an electrical connection.

However, it has been difficult to increase the electrode arrangement density as conventional connectors have become more compact and dense. Because the arm portion 953 of the female-side electrode pattern 951 is widened in the lateral direction by a male-side electrode protrusion, there is a possibility that arm portions 953 of adjacent female-side electrode patterns 951 will contact each other when the pitch or lateral interval between female-side electrode patterns 951 is reduced. Because the positions of the wide portions and narrow portion of the inner openings 954*a* of adjacent female-side electrode patterns 951 are staggered in the vertical direction in a conventional connector, there is also a possibility that contact arm portions 953 will contact each other. Here, the positioning of the female-side electrode patterns 951 and male-side electrode protrusions is limited to a so-called zigzag pattern, which reduces the degree of freedom with respect to terminal placement.

In other conventional connectors, when the positioning of the protruding terminals 1051 is different in the lateral direction of the female connector 1101, spring force is not applied equally to all of the protruding terminals 1051. Instead, strong spring force is applied to some of the protruding terminals 1051, and force is transmitted to the solder connecting the circuit board and the tail portions 1058 which causes cracking of the solder. Similarly, when high stress occurs in the tail portions 1158 and reinforcing brackets 1156 of some of the resilient terminals 1151, cracking occurs in the solder connecting them to the board. Thus, connection reliability decreases when solder cracking occurs.

SUMMARY OF THE PRESENT DISCLOSURE

The purpose of the Present Disclosure is to solve the problem associated with a conventional connector by providing an easy-to-manufacture, low-cost, compact, reliable connector with a simple configuration, in which a first terminal member of a plate-like terminal engaging a protruding terminal generates spring force towards the center of the connector in the lateral direction and applies pressure to the protruding terminal such that there is no possibility of adjacent plate-like terminals contacting each other even when the plate-like terminals have a narrow pitch; such that stable contact can be maintained between protruding terminals and plate-like terminals; and such that brief interruptions can be reliably prevented.

In a connector of the Present Disclosure, which is a connector having a plate-like conductive portion including a plurality of conductive patterns and which is mated with another connector, each conductive pattern includes a plate-like terminal engaging a protruding terminal on the other connector. The plate-like terminal includes a protruding terminal receiving opening for receiving the protruding terminal, a beam-like first terminal member positioned to the side of the protruding terminal receiving opening, and a first contact portion formed in the first terminal member. The first terminal member generates spring force towards the center of the connector in the lateral direction when the protruding terminal received inside the protruding terminal receiving opening moves relative to the first contact portion.

In another connector of the Present Disclosure, the plate-like terminal of each conductive pattern has an asymmetrical shape relative to the centerline of each conductive pattern in the lateral direction, and the plurality of conductive patterns is formed in a row extending in the lateral direction of the conductor, the shape of the plate-like terminals being arranged so as to be symmetrical relative to the centerline of the conductor in the lateral direction. In a further connector of the Present Disclosure, the first terminal member includes a curved portion, and the curved portion is curved to bow outward in the direction opposite the center of the connector in the lateral direction. In still another connector of the Present Disclosure, the first terminal member generates spring force towards the center of the connector in the lateral direction when the protruding terminal received inside the curved portion at the protruding terminal receiving opening moves relative to the first contact portion. In an additional connector of the Present Disclosure, the plate-like terminal includes a second terminal member positioned on the opposite side of the first terminal member at the protruding terminal receiving opening, and a second contact portion formed in the second terminal portion facing the first contact portion, at least one of the protruding terminals being pinched between the first contact portion and the second contact portion. In yet another connector of the Present Disclosure, the first terminal member in the plate-like terminal of the conductive pattern arranged on the right side of the centerline of the connector in the lateral direction is positioned to the right of the protruding terminal receiving opening, and the first terminal member in the plate-like terminal of the conductive pattern arranged on the left side of the centerline of the connector in the lateral direction is positioned to the left of the protruding terminal receiving opening. In a subsequent connector of the Present Disclosure, the dimension of the transverse cross-sectional shape of the protruding terminal is greater in the lateral direction than in the longitudinal direction.

The connector of the Present Disclosure has a first terminal member of a plate-like terminal engaging a protruding terminal which generates spring force towards the center of the connector in the lateral direction and applies pressure to the protruding terminal. As a result, there is no possibility of adjacent plate-like terminals contacting each other even when the plate-like terminals have a narrow pitch, stable contact can be maintained between protruding terminals and plate-like terminals, and brief interruptions can be reliably prevented. In addition, the connector is easy to manufacture, has a simple configuration, is inexpensive and compact, and is highly reliable.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 2 is an exploded perspective view showing the layer structure of the first connector of FIG. 1, in which FIG. 2(*a*) is a view of the mounted face and FIG. 2(*b*) is a view of the mated face;

FIG. 11 is a perspective view of another conventional connector, in which FIG. 11(*a*) shows the male connector and FIG. 11(*b*) shows the female connector.

DESCRIPTION OF THE PREFERRED EMBODIMENTS

Figure 1A:
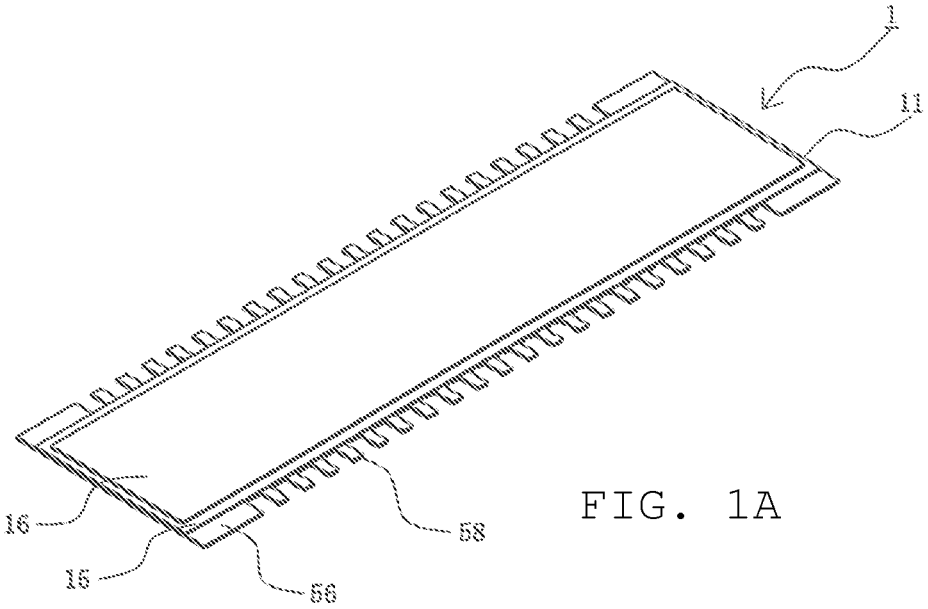
FIG. 1 is a perspective view showing a first connector according to an embodiment of the Present Disclosure, in which FIG. 1(*a*) is a view of the mounted face and FIG. 1(*b*) is a view of the mated face.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features.

While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to the Figures, 1 is a male, first, connector, which is one of the connectors in the embodiment. This connector is a surface-mounted connector mounted on the surface of a first board (not shown), which is the first mounted member, and this connector is connected electrically to a female, second, connector 101 described below. The female connector 101 is a surface-mounted connector mounted on the surface of a second board (also not shown), which is the second mounted member. In other words, in the present embodiment, the male connector 1 and the female connector 101 are used to establish an electrical connection between the first board and the second board. The first board and the second board can be any type of board, examples of which may include printed circuit boards used in electronic devices, flexible flat cables and flexible printed circuit boards.

The male connector 1 has a plate-like main body portion 11 with a rectangular planar shape. The main body portion 11 includes a reinforcing layer 16 serving as a plate-like reinforcing portion, which is a flat, thin plate member from the mounted face side (the side shown in FIGS. 1(*a*) and 2(*a*)); a base film 15 serving as a male base plate portion, which is a plate-like first base plate portion or an insulating thin plate portion having a slender, band-like shape; and a conductive portion 50 serving as a male conductive portion, which is a plate-like first conductive portion arranged on one face of the base film 15 (the face on the mated face side). The conductive portion 50 has a plurality of conductive patterns 51 separated by pattern separating space 52. The base film 15 can be any material insulating material. A reinforcing layer 16 serving as a plate-like reinforcing portion is a flat, thin plate member provided on the other face of the base film 15 (the face on the mounted face side). The reinforcing layer 16 may be made of a metal, but can also be made of some other material such as a resin or a composite material containing glass fibers or carbon fibers.

The conductive patterns 51 are formed, for example, by applying copper foil having a thickness ranging from several μm to several tens of μm on one face of the base film 15 and then by patterning the copper foil using the etching process. These conductive patterns extend longitudinally in the male connector 1 in the short-axis direction of the main body portion 11, and are arranged parallel to each other in the lateral direction in the male connector 1 in the long-axis direction of the main body portion 11. Adjacent conductive patterns 51 are separated by a pattern separating space 52.

Each conductive pattern 51 is a male conductor and a first conductor functioning as a plurality of conductive wires arranged in parallel. Each is exposed on the mated face of the main body portion 11, and has a single protruding terminal 53 serving as a male terminal and opposing terminal. In the example shown, the conductive patterns 51 and the protruding terminals 53 are arranged in parallel to each other at a predetermined pitch, so that two rows extend in the lateral direction of the male connector 1. Each protruding terminal 53 is a member protruding from the surface of a conductive pattern 51, and is integrated with the conductive pattern 51, for example, by performing etching using the photolithographic technique.

Figure 3A:
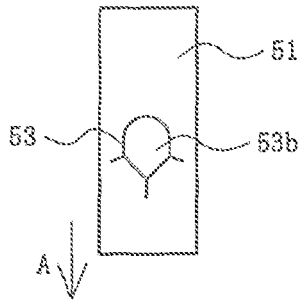
FIG. 3 is an enlarged view of a male terminal in the first connector of FIG. 1, in which FIG. 3(*a*) is a top view, FIG. 3(*b*) is a front view and FIG. 3(*c*) is a perspective view.
Figure 3B:
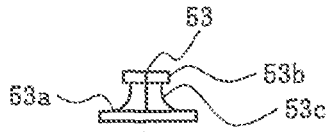
Figure 3C:
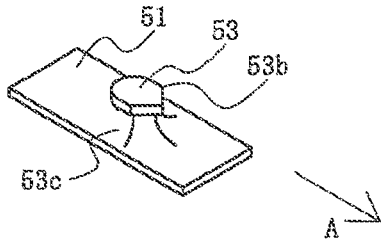

As shown in FIG. 3, the dimension of the top face and transverse section of the protruding terminals 53 is preferably greater in the longitudinal direction than in the lateral direction. They preferably have a shape which has an inclined portion in the forward direction, for example, a pentagonal or hexagonal shape providing a spherical home base with a point in the forward direction. Arrow A in FIGS. 1-3 indicates the forward direction of the male connector 1.

In the present embodiment, the side face shape of the protruding terminals 53 is preferably a recessed face as shown in FIG. 3. More specifically, in the protruding terminals 53, the width dimension of the base portion 53*a*, which is the portion connected to the surface of the conductive pattern 51, is equal to or greater than the tip portion 53*a*, which is the upper end portion. Also, the side portion 53*c* between the base portion 53*a* and the tip portion 53*b* is a smooth face with a smooth shape recessed towards the inside in the lateral direction from both the base portion 53*a* and the tip portion 53*b*. The shape of the side portion 53*c* is preferably a gentle, continuously curved face.

Figure 1B:
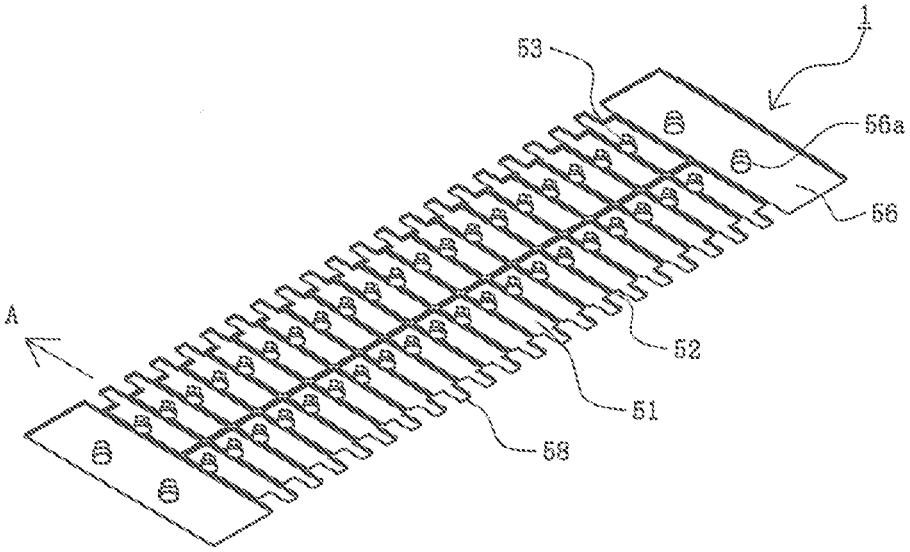

Each conductive pattern 51 also has a tail portion 58 extending in the short axis direction of the main body portion 11. As shown in FIG. 1(*a*), each tail portion 58 protrudes from the base film 15 to the outside, and is connected by solder to a connecting pad formed on the surface of the first board not shown in the drawing. In this way, the male connector 1 is mounted on the first board, and the conductive patterns 51 and protruding terminals 53 are connected electrically to the connecting pads on the first board.

A reinforcing bracket 56 including engaging protruding portions 56*a* is provided on both sides of the conductive patterns 51. The reinforcing brackets 56 are formed along with the conductive patterns 51 by applying copper foil having a thickness ranging from several μm to several tens of μm on one face of the base film 15, and then patterning the copper foil using etching so that the brackets extend in the short axis direction of the main body portion 11, and are provided on both ends of the main body portion 11 in the long axis direction separated from the conductive patterns 51.

A portion of the bottom face of the reinforcing brackets 56 is exposed on the mounted face of the main body portion 11, and the exposed portion is connected by solder to fixing pads formed on the surface of the first board. In this way, the male connector 1 is secured to the first board. Also, the engaging protruding portions 56*a* engage the engaging portions 157 of the female connector 101 as described below, and the male connector 1 and the female connector 101 are properly positioned.

The female connector 101, which is the second connector of the present embodiment, has a flat, rectangular shape. It is connected electrically to the male connector 1, or first connector, and is mounted on the surface of a second board (not shown), such as a printed circuit board, flexible flat cable or flexible circuit board. The female connector 101 is plate-like, has a mounted face which faces the surface of the second board (the face on the opposite side in FIG. 4), and is connected electrically to conductive traces on the second board.

The female connector 101 has a plate-like main body portion 111 with a rectangular planar shape. The main body portion 111 includes a reinforcing layer 116 serving as a reinforcing plate portion, which comprises a plurality of slender plate-like members extending from the mounted face side (the opposite side in FIG. 4) in the longitudinal direction of the main body portion 111; cover film 117 serving as the female base portion, or the first base portion, comprising a plurality of slender insulated thin plate members having the same surface shape as the reinforcing layer 116; a conductive portion 150 serving as a female conductive portion or plate-like second conductive portion; and base film 115 serving as the female base portion, or first base portion, comprising a plurality of slender, insulating thin plate members having the same surface shape as the cover film 117. The conductive portion 150 has a plurality of conductive patterns 151 separated by pattern separating spaces 152. The base film 115 and cover film 117 can be made of any insulating material. The reinforcing layer 116 is made of a metal, but can also be made of some other material such as a resin or a composite material containing glass fibers or carbon fibers. The conductive patterns 151 can be formed by patterning copper foil having resiliency and a thickness from several μm to several tens of μm using the etching process.

In the example shown, the conductive patterns 151 extend in the short axis direction of the main body portion 111 in the longitudinal direction of the female connector 101, are arranged in parallel in the long axis direction of the main body portion 111 in the lateral direction of the female connector 101, and adjacent conductive patterns 151 are separated by pattern separating spaces 152. Each conductive pattern 151 has a terminal receiving opening 154 and a receiving terminal 153 is formed as a female terminal or plate-like terminal and positioned inside the terminal receiving opening 154.

In the example shown, the conductive patterns 151 are arranged in parallel to each other at a predetermined pitch, so that two rows extend in the lateral direction of the female connector 101. The receiving terminals 153 are mated with the protruding terminals 53 of the male connector 1, and so are arranged in a manner similar to the protruding terminals 53. When the arrangement of the protruding terminals 53 is changed, the arrangement of the receiving terminals 153 has to be changed to achieve a match. The arrangement of the conductive patterns 151 is also similar to the arrangement of the conductive patterns 51 of the male connector 1. When the arrangement of the conductive patterns 51 in the male connector 1 is changed, the arrangement of the conductive patterns 151 has to be changed to achieve a match.

In the example shown, there are three layers consisting of a reinforcing layer 116, cover film 117 and base film 115, and these are arranged to extend in the long axis direction of the main body portion 111 in the central portion and near both ends with respect to the short axis direction of the main body portion 111. As a result, both faces of the conductive patterns 151 arranged in parallel to each other in two rows are covered by a reinforcing layer 116, cover film 117, and base film 115, and the portions in which the receiving terminals 153 and the terminal receiving openings 154 are exposed.

Figure 4:
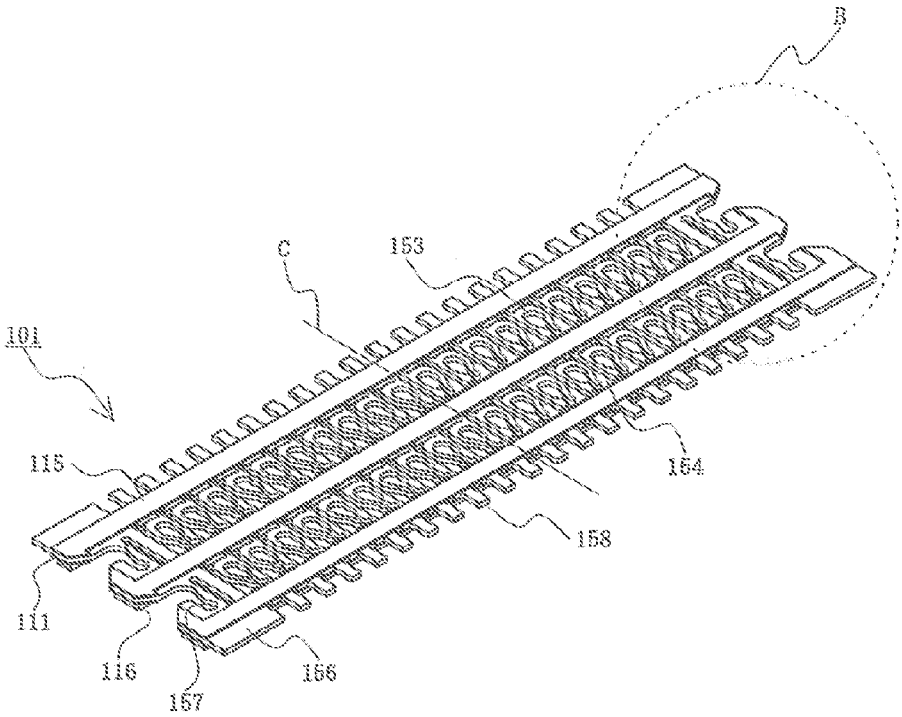
FIG. 4 is a perspective view showing a second connector according to an embodiment of the Present Disclosure.

Each conductive pattern 151 has a tail portion 158 extending in the short axis direction of the main body portion 111. As shown in FIG. 4, each tail portion 158 protrudes outward from the reinforcing layer 116, the cover film 117, and the base film 115, and are connected by solder to connecting pads formed in the surface of the second board not shown in the drawing. In this way, the female connector 101 is mounted on the second board, and the conductive patterns 151 and receiving terminals 153 are connected electrically to the connecting pads on the second board.

A reinforcing bracket 156 including engaging portions 157 is provided on both sides of the conductive patterns 151. The reinforcing brackets 156 are formed along with the conductive patterns 151 by applying copper foil having resiliency, and then patterning the copper foil using etching so that the brackets extend in the short axis direction of the main body portion 111, and are provided on both ends of the main body portion 111 in the long axis direction separated from the conductive portion 150.

A portion of the bottom face of the reinforcing brackets 156 is exposed on the mounted face of the main body portion 111, and the exposed portion is connected by solder to fixing pads formed on the surface of the second board. In this way, the female connector 101 is secured to the second board. Also, the engaging portions 157 engage the engaging protruding portions **56*a* of the male connector 1, and the male connector 1 and the female connector 101** are properly positioned.

Each of the receiving terminals 153 is a member received inside a substantially rectangular terminal receiving opening 154 passing through the conductive pattern 151 in the thickness direction. The terminals are formed, for example, by patterning the conductive patterns 151 by performing etching using the photolithographic technique. Typically, the portions remaining after the conductive patterns 151 have been etched from the receiving terminals 153, and the portions where the material surrounding the receiving terminals 153 has been removed from the terminal receiving openings 154. Therefore, the thickness of the receiving terminals 153 is the same as the thickness of the conductive patterns 151.

Figure 6:
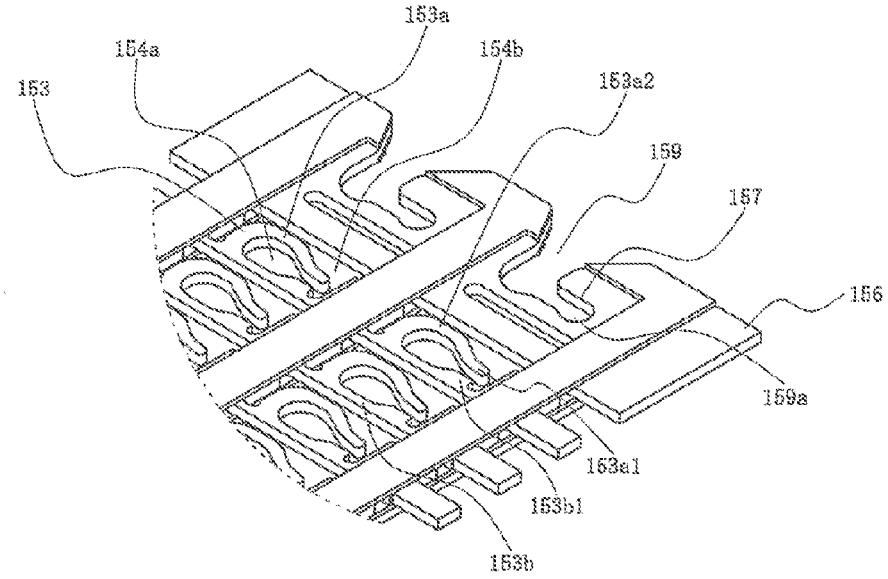
FIG. 6 is an enlarged view of Portion B of FIG. 4, showing the important components of the second connector of FIG. 4.
Figure 7A:
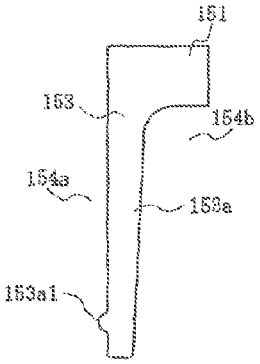
FIG. 7 illustrates top views showing various examples of female terminals in the second connector of FIG. 4, in which FIGS. 7(*a*)-(*f*) are the first through sixth examples.
Figure 7B:
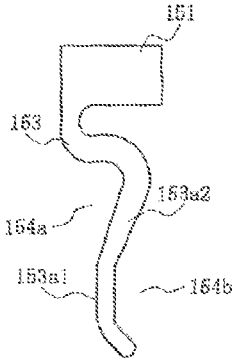
Figure 7C:
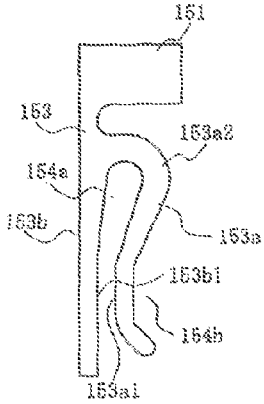
Figure 7D:
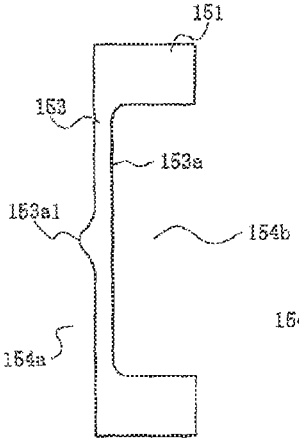
Figure 7E:
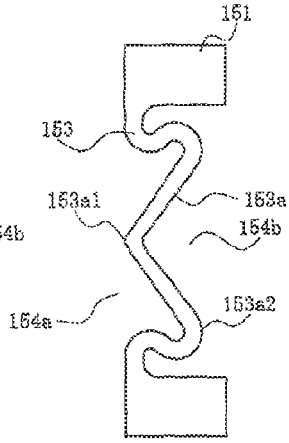
Figure 7F:
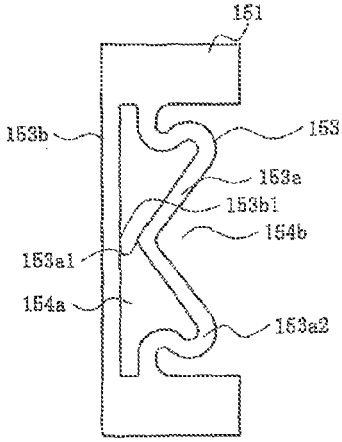

The engaging portions 157 include engaging openings 159 passing through the reinforcing brackets 156 in the thickness direction and are formed in the same manner as the receiving terminals 153 by patterning the reinforcing brackets 156 by performing an etching using a photolithographic technique. The engaging openings 159 are the portions which engage the engaging protruding portions **56*a* of the male connector 1. As shown in FIG. 6, they have a substantially L-shaped profile, and a holding portion 159*a* for holding an engaging protruding portion 56*a* is formed in the innermost portion. In the engaging opening 159, the width of the entrance portion is greater than the outer diameter of the engaging protruding portion 56*a*, and the width of the portion communicating with the holding portion 159*a* is somewhat smaller than the outer diameter of the engaging protruding portion 56*a*. In this way, the engaging protruding portion 56*a* received in the holding portion 159*a*** is reliably held in place.

Each receiving terminal 153, as shown in FIG. 6, has a resilient arm portion **153*a* serving as a first terminal member and a fixed arm portion 153*b* serving as a second terminal member. The resilient arm portion 153*a* is the member functioning as the spring portion. It is a slender member having a substantially L-shaped planar shape whose base curves and connects to the side edge of the fixed arm portion 153*b* at a portion near one end of the main body portion 111 in the short axis direction inside the terminal receiving opening 154 (the vertical direction of the terminal receiving opening 154), and is positioned to one side of the fixed arm portion 153*b*. The resilient arm portion 153*a* is a type of cantilevered beam whose free end is a resilient contact portion 153*a*1 serving as a first contact portion formed or connected at or near the tip, and which is positioned near the other end of the main body portion 111 in the short axis direction inside the terminal receiving opening 154. In other words, the resilient arm portion 153*a* has a planar shape including a curved portion 153*a*2 curved so the portion between the base and the tip protrudes towards the side of the fixed arm portion 153*b*. The resilient contact portion 153*a*1 is elastically displaced in the long axis direction of the main body portion 111 (in the lateral direction of the terminal receiving opening 154) by the elastic deformation of the resilient arm portion 153*a***.

The fixed arm portion **153*b* is a slender member extending linearly in the short axis portion of the main body portion 111**.

The reinforcing layer 116, the cover film 117, and the base film 115 are affixed to both ends. As a result, the fixed arm portion 153*b* is more rigid than the resilient arm portion 153*a*, and functions as a rigid portion in which hardly any resilient deformation occurs. A rigid contact portion 153*b*1 is formed as a second contact portion in the side edge of the fixed arm portion 153*b* so as to protrude towards the resilient contact portion 153*a*1. The rigid contact portion 153*b*1 is not elastically deformed in the long axis direction of the main body portion 111 (the lateral direction of the terminal receiving opening 154), but instead remains fixed. The rigid contact portion 153*b*1 does not have to have a shape which protrudes from a side edge of the fixed arm portion 153*b*. It can instead have a shape which is recessed from the side edge of the fixed arm portion 153*b*, or a shape which is linear with respect to the side edge of the fixed arm portion 153*b*.

Each terminal receiving opening 154 includes an inner opening 154*a* serving as the protruding terminal receiving opening formed between the resilient arm portion 153*a* and the fixed arm portion 153*b* and an outer opening 154*b* formed to the outside of the resilient arm portion 153*a*. The inner opening 154*a* is the portion that receives the inserted protruding terminal 53 when the receiving terminal 153 is mated with a protruding terminal 53 on the male connector 1, and the outer opening 154*b* is the portion that allows for deformation of the resilient arm portion 153*a*.

The dimension of the inner portion of the curved portion 153*a*2 in the inner opening 154*a* is larger than the outer dimension of the tip portion 53*b* of the protruding terminal 53. In this way, the protruding terminal 53 can be smoothly inserted into the inner opening 154*a* when the receiving terminal 153 is mated with the protruding terminal 53. Also, the dimension between the resilient contact portion 153*a*1 and the rigid contact portion 153*b*1 in the inner opening 154*a* is smaller than the width dimension of the inner opening 154*a* of the curved portion 153*a*2, and smaller than the cross-sectional diameter or width dimension of the protruding terminal 53. The width dimension of the inner opening 154*a* is somewhat smaller near the resilient contact portion 153*a*1. When the protruding terminal 53 received inside the inner opening 154*a* moves relative to the portion between the resilient contact portion 153*a*1 and the rigid contact portion 153*b*1, the interval between the resilient contact portion 153*a*1 and the rigid contact portion 153*b*1 comes into contact with the side portion 53*c* of the protruding terminal 53 and is pushed apart. Because of the fixed arm portion 153*b*, the rigid contact portion 153*b*1 is not displaced. However, the resilient arm portion 153*a* is elastically deformed, and the resilient contact portion 153*a*1 is elastically displaced. As a result, the protruding terminal 53 receives contact pressure from the resilient arm portion 153*a*.

Because the resilient arm portion 153*a* positioned in one receiving terminal 153 is displaced to the outside in the lateral direction, while the fixed arm portion 153*b* positioned on another one is not displaced to the outside in the lateral direction, the outward displacement of the receiving terminal 153 in the lateral direction, that is, the bulging, is slight. As a result, adjacent receiving terminals 153 are unlikely to contact each other, and the pitch of the receiving terminals 153 can be reduced.

The receiving terminal 153 in each conductive pattern 151 has an asymmetrical shape rather than a line symmetrical shape relative to the centerline of each conductive pattern 151 in the lateral direction. In other words, in each terminal receiving opening 154, the resilient arm portion 153*a* is positioned only to one side of the terminal receiving opening 154 in the lateral direction (the right side in the example shown in FIG. 6). As a result, each protruding terminal 53 receives contact pressure in one direction. Therefore, if the shape of the receiving terminal 153 and the terminal receiving opening 154 is the same in all of the conductive patterns 151, the male conductor 1 with protruding terminals 53 receives pressure in one direction (to the left in the example shown in FIG. 6) from the female connector 101. Also, the female connector 101 receives rebound force in the opposite direction (to the right in the example shown in FIG. 6) from the male connector 1. This makes the mated connectors 1, 101 unstable.

In the embodiment, the spring portion of the plate-like receiving terminal 153; that is, the resilient arm portion 153*a*, engaging the protruding terminal 53 generates spring force towards the center of the female connector 101 in the lateral direction. More specifically, as shown in FIG. 4, the conductive pattern 151 is patterned to form a receiving terminal 153 and a terminal receiving opening 154 that are line symmetrical with respect to the centerline C of the female connector 101 in the lateral direction. In the example shown in FIG. 4, the conductive patterns 151 positioned to the right of the centerline C have a resilient arm portion 153*a* positioned to the right of the fixed arm portion 153*b*, and the spring force of the resilient arm portion 153*a* is directed to the left (the direction of the centerline C). The conductive patterns 151 positioned to the left of the centerline C have a resilient arm portion 153*a* positioned to the left of the fixed arm portion 153*b*, and the spring force of the resilient arm portion 153*a* is directed to the right (the direction of the centerline C). In this way, the mated male connector 1 and female connector 101 are stable, and stable contact is maintained between all protruding terminals 53 and receiving terminals 153.

Figure 5:
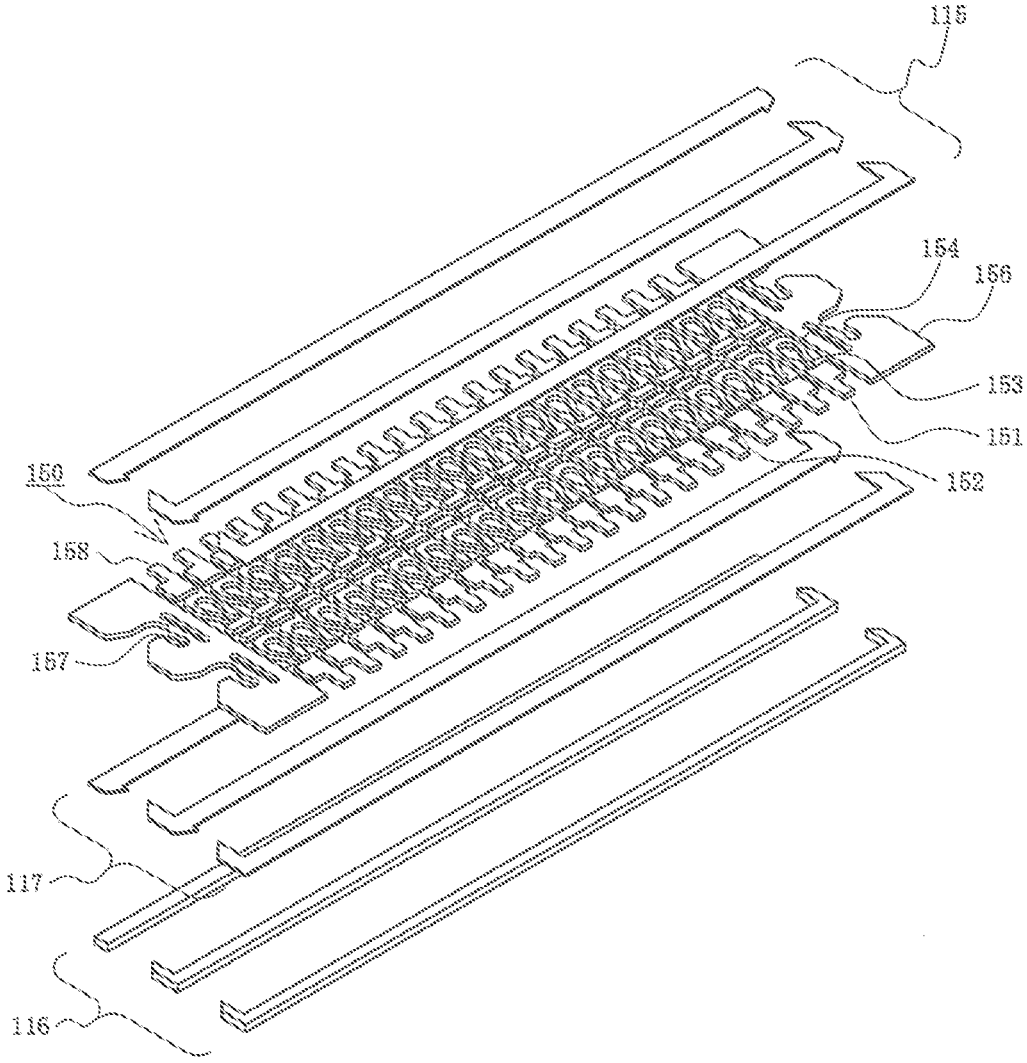
FIG. 5 is an exploded perspective view showing the layer structure of the second connector of FIG. 4.

In the present embodiment, the receiving terminal 153 is not limited to the example shown in FIGS. 4-6. It can have any of the planar shapes shown in FIGS. 7(*a*)-(*f*). The up and down directions in FIGS. 7(*a*)-(*f*) correspond to the front and rear of the female connector 101.

In the example shown in FIG. 7(*a*), the receiving terminal 153 does not have a fixed arm portion 153*b* serving as a second terminal member. Instead, it only has a resilient arm portion 153*a* serving as a first terminal member. The resilient arm portion 153*a* is a cantilevered beam-like member extending linearly, and does not have a curved portion 153*a*2. The free end of the resilient arm portion 153*a*, that is, the resilient contact portion 153*a*1, at or near the tip is elastically displaced in the long axis direction of the main body portion 111 (the lateral direction of the terminal receiving opening 154) by the elastic deformation of the resilient arm portion 153*a*.

In the example shown in FIG. 7(*a*), the left space and right space of the resilient arm portion 153*a* correspond to the outer opening 154*b* and the inner opening 154*a* in the example shown in FIGS. 4-6. The inner opening 154*a* is the portion that receives the inserted protruding terminal 53 when the receiving terminal 153 is mated with a protruding terminal 53 on the male connector 1, and the outer opening 154*b* is the portion that allows for deformation of the resilient arm portion 153*a*.

Because the resilient contact portion 153*a*1 has a shape protruding to the left in the drawing, the protruding terminal 53 entering the inner opening 154*a* moves along the resilient arm portion 153*a*. When the resilient contact portion 153*a*1 moves relative to the tip of the resilient arm portion 153*a*, the side portion 53*c* of the protruding terminal 53 comes into contact with the resilient contact portion 153*a*1. As a result, the resilient arm portion 153*a* is elastically deformed, and the resilient contact arm portion 153*a*1 is elastically deformed to the right in the drawing. In this way, the protruding terminal 53 receives contact pressure from the resilient arm portion 153*a*.

In the example shown in FIG. 7(*a*), the receiving terminal 153 has an asymmetrical shape rather than a line symmetrical shape relative to the centerline of each conductive pattern 151 in the lateral direction similar to the example shown in FIGS. 4-6. In other words, in each terminal receiving opening 154, the resilient arm portion 153*a* is positioned only to one side of the inner opening 154*a* in the lateral direction (the right side in the example shown in FIG. 7 (*a*)). As a result, each protruding terminal 53 receives contact pressure in one direction. Thus, as in the example shown in FIGS. 4-6, the spring force generated by the spring portion of the receiving terminal 153, that is, the resilient arm portion 153*a*, is generated towards the center of the female connector 101 in the lateral direction. More specifically, as shown in FIG. 4, the receiving terminals 153 and terminal receiving openings 154 are formed by patterning the conductive patterns 151 so as to be line symmetrical with respect to the centerline C of the female connector 101 in the lateral direction. In other words, the conductive patterns 151 positioned to the right of the centerline C have the shape shown in FIG. 7(*a*), and the conductive patterns 151 positioned to the left of the centerline C have a shape that is the mirror image of the shape shown in FIG. 7 (*a*) in which left and right have been reversed.

In the example shown in FIG. 7(*b*), the receiving terminal 153 does not have a fixed arm portion 153*b* serving as a second terminal member, but only has a resilient arm portion 153*a* serving as a first terminal member. The resilient arm portion 153*a* is a cantilevered beam-like member extending in a curved shape and has a curved portion 153*a*2. The free end, that is, the resilient contact portion 153*a*1, at or near the tip is elastically displaced in the long axis direction of the main body portion 111 (the lateral direction of the terminal receiving opening 154) by the elastic deformation of the resilient arm portion 153*a*.

In the example shown in FIG. 7(*b*), as in the example shown in FIG. 7(*a*), the left space and right space of the resilient arm portion 153*a* correspond to the outer opening 154*b* and the inner opening 154*a* in the example shown in FIGS. 4-6. The inner opening 154*a* is the portion that receives the inserted protruding terminal 53 when the receiving terminal 153 is mated with a protruding terminal 53 on the male connector 1, and the outer opening 154*b* is the portion that allows for deformation of the resilient arm portion 153*a*.

The curved portion 153*a*2 curves to bulge into the outer opening 154*b*. As a result, the inner opening 154*a* is wider at the base end of the resilient arm portion 153*a*, and becomes narrower towards the tip of the resilient arm portion 153*a* as the resilient contact portion 153*a*1 is approached. The resilient contact portion 153*a*1 also protrudes to the left in the Figure. In this way, when a protruding terminal 53 inside an inner opening 154*a* moves towards the tip of the resilient arm portion 153*a* in which the resilient contact portion 153*a*1 is formed, the side portion 53*c* of the protruding terminal 53 comes into contact with the resilient contact portion 153*a*1, the resilient arm portion 153*a* becomes elastically deformed, and the resilient contact portion 153*a*1 is elastically displaced to the right in the Figure. As a result, the protruding terminal 53 receives contact pressure from the resilient arm portion 153*a*.

In the example shown in FIG. 7(*b*), the receiving terminal 153 has an asymmetrical shape rather than a line symmetrical shape relative to the centerline of each conductive pattern 151 in the lateral direction similar to the example shown in FIGS. 4-6. In other words, in each terminal receiving opening 154, the resilient arm portion 153*a* is positioned only to one side of the inner opening 154*a* in the lateral direction (the right side in the example shown in FIG. 7(*b*)). As a result, each protruding terminal 53 receives contact pressure in one direction. Thus, as in the example shown in FIGS. 4-6, the spring force generated by the spring portion of the receiving terminal 153, that is, the resilient arm portion 153*a*, is generated towards the center of the female connector 101 in the lateral direction. More specifically, as shown in FIG. 4, the receiving terminals 153 and terminal receiving openings 154 are formed by patterning the conductive patterns 151 to be line symmetrical with respect to the centerline C of the female connector 101 in the lateral direction. In other words, the conductive patterns 151 positioned to the right of the centerline C have the shape shown in FIG. 7(*b*), and the conductive patterns 151 positioned to the left of the centerline C have a shape that is the mirror image of the shape shown in FIG. 7(*b*) in which left and right have been reversed.

In the example shown in FIG. 7(*c*), as in the example shown in FIGS. 4-6, the receiving terminal 153 has a resilient arm portion 153*a* serving as a first terminal member and a fixed arm portion 153*b* serving as a second terminal member. The resilient arm portion 153*a* is a slender member having an L-shaped planar shape including a curved portion 153*a*2 and a base which curves and connects to the side edge of the fixed arm portion 153*b*, and is positioned to one side of the fixed arm portion 153*b*. The resilient arm portion 153*a* is a type of cantilevered beam whose free end is a resilient contact portion 153*a*1 serving as a first contact portion formed or connected at or near the tip. The resilient contact portion 153*a*1 is elastically displaced in the long axis direction of the main body portion 111 (in the lateral direction of the terminal receiving opening 154) by the elastic deformation of the resilient arm portion 153*a*. Also, the position on the side edge of the fixed arm portion 153*a* facing the resilient contact portion 153*a*1 has a rigid contact portion 153*b*1, and this rigid contact portion 153*b*1 is formed in a shape which is linear with respect to the side edge of the fixed arm portion 153*b*.

In the example shown in FIG. 7(*c*), the terminal receiving opening 154 includes an inner opening 154*a* formed between the resilient arm portion 153*a* and the fixed arm portion 153*b* and an outer opening 154*b* formed to the outside of the resilient arm portion 153*a*. When a receiving terminal 153 is mated with a protruding terminal 53 on the male connector 1, the inner opening 154*a* is the portion receiving the protruding terminal 53, and the outer opening 154*b* is the portion allowing for displacement of the resilient arm portion 153*a*. The rest of the configuration and operation of the example shown in FIG. 7(*c*) is similar to the example shown in FIG. 7(*b*), so further explanation has been omitted.

In the example shown in FIG. 7(*d*), the receiving terminal 153 has a planar shape that is vertically symmetrical but not horizontally symmetrical, and does not have a fixed arm portion 153*b* serving as a second terminal member, but only a resilient arm portion 153*a* serving as a first terminal member. The resilient arm portion 153*a* is a cantilevered beam-like member extending linearly, and does not have a curved portion 153*a*2. Both ends connect to the remaining conductive pattern 151, and the resilient contact portion 153*a*1 at or near the tip is elastically displaced in the long axis direction of the main body portion 111 (the lateral direction of the terminal receiving opening 154) by the elastic deformation of the resilient arm portion 153*a*.

In the example shown in FIG. 7(*d*), the left space and right space of the resilient arm portion 153*a* correspond to the outer opening 154*b* and the inner opening 154*a* in the example shown in FIGS. 4-6. The inner opening 154*a* is the portion that receives the inserted protruding terminal 53 when the receiving terminal 153 is mated with a protruding terminal 53 on the male connector 1, and the outer opening 154*b* is the portion that allows for deformation of the resilient arm portion 153*a*.

Because the resilient contact portion 153*a*1 has a shape protruding to the left in the drawing, the protruding terminal 53 entering the inner opening 154*a* moves along the resilient arm portion 153*a*. When the resilient contact portion 153*a*1 moves relative to the tip of the resilient arm portion 153*a*, the side portion 53*c* of the protruding terminal 53 comes into contact with the resilient contact portion 153*a*1. As a result, the resilient arm portion 153*a* is elastically deformed, and the resilient contact arm portion 153*a*1 is elastically deformed to the right in the drawing. In this way, the protruding terminal 53 receives contact pressure from the resilient arm portion 153*a*.

In the example shown in FIG. 7(*d*), the receiving terminal 153 has an asymmetrical shape rather than a line symmetrical shape relative to the centerline of each conductive pattern 151 in the lateral direction similar to the example shown in FIGS. 4-6. In other words, in each terminal receiving opening 154, the resilient arm portion 153*a* is positioned only to one side of the inner opening 154*a* in the lateral direction (the right side in the example shown in FIG. 7(*d*)). As a result, each protruding terminal 53 receives contact pressure in one direction. Thus, as in the example shown in FIGS. 4-6, the spring force generated by the spring portion of the receiving terminal 153, that is, the resilient arm portion 153*a*, is generated towards the center of the female connector 101 in the lateral direction. More specifically, as shown in FIG. 4, the receiving terminals 153 and terminal receiving openings 154 are formed by patterning the conductive patterns 151 so as to be line symmetrical with respect to the centerline C of the female connector 101 in the lateral direction. In other words, the conductive patterns 151 positioned to the right of the centerline C have the shape shown in FIG. 7(*d*), and the conductive patterns 151 positioned to the left of the centerline C have a shape that is the mirror image of the shape shown in FIG. 7(*d*) in which left and right have been reversed.

In the example shown in FIG. 7(*e*), the receiving terminal 153 has a planar shape vertically symmetrical but not horizontally symmetrical, and does not have a fixed arm portion 153*b* serving as a second terminal member, but only a resilient arm portion 153*a* serving as a first terminal member. The resilient arm portion 153*a* includes a curved portion 153*a*2, and is a wedge-shaped beam-like member or a pair of joined members curved into an L-shape. Both ends connect to the remaining conductive pattern 151, and the resilient contact portion 153*a*1 at or near the tip is elastically displaced in the long axis direction of the main body portion 111 (the lateral direction of the terminal receiving opening 154) by the elastic deformation of the resilient arm portion 153*a*.

In the example shown in FIG. 7(*e*), the left space and right space of the resilient arm portion 153*a* correspond to the outer opening 154*b* and the inner opening 154*a* in the example shown in FIGS. 4-6. The inner opening 154*a* is the portion that receives the inserted protruding terminal 53 when the receiving terminal 153 is mated with a protruding terminal 53 on the male connector 1, and the outer opening 154*b* is the portion that allows for deformation of the resilient arm portion 153*a*.

Because the curved portion 153*a*2 is curved so as to bulge into the outer opening 154*b* near both ends of the resilient arm portion 153*a*, and because the resilient contact portion 153*a*1 is a corner portion protruding away from the central portion (to the left in the drawing), the inner opening 154*a* is wider at the base end of the resilient arm portion 153*a*, and becomes narrower towards the tip of the resilient arm portion 153*a* as the resilient contact portion 153*a*1 is approached. In this way, when a protruding terminal 53 inside an inner opening 154*a* moves towards the tip of the resilient arm portion 153*a* in which the resilient contact portion 153*a*1 is formed, the side portion 53*a* of the protruding terminal 53 comes into contact with the resilient contact portion 153*a*1, the resilient arm portion 153*a* becomes elastically deformed, and the resilient contact portion 153*a*1 is elastically displaced to the right in the drawing. As a result, the protruding terminal 53 receives contact pressure from the resilient arm portion 153*a*.

In the example shown in FIG. 7(*e*), the receiving terminal 153 has an asymmetrical shape rather than a line symmetrical shape relative to the centerline of each conductive pattern 151 in the lateral direction similar to the example shown in FIGS. 4-6. In other words, in each terminal receiving opening 154, the resilient arm portion 153*a* is positioned only to one side of the inner opening 154*a* in the lateral direction (the right side in the example shown in FIG. 7(*e*)). As a result, each protruding terminal 53 receives contact pressure in one direction. Thus, as in the example shown in FIGS. 4-6, the spring force generated by the spring portion of the receiving terminal 153, that is, the resilient arm portion 153*a*, is generated towards the center of the female connector 101 in the lateral direction. More specifically, as shown in FIG. 4, the receiving terminals 153 and terminal receiving openings 154 are formed by patterning the conductive patterns 151 so as to be line symmetrical with respect to the centerline C of the female connector 101 in the lateral direction. In other words, the conductive patterns 151 positioned to the right of the centerline C have the shape shown in FIG. 7(*e*), and the conductive patterns 151 positioned to the left of the centerline C have a shape that is the mirror image of the shape shown in FIG. 7(*e*) in which left and right have been reversed.

In the example shown in FIG. 7(*f*), the receiving terminal 153 has a planar shape vertically symmetrical but not horizontally symmetrical, and has both a resilient arm portion 153*a* serving as a first terminal member and a fixed arm portion 153*b* serving as a second terminal member. The resilient arm portion 153*a* is a wedge-shaped beam-like member or a pair of joined members curved into an L-shape. Both ends connect to the remaining conductive pattern 151, and is positioned to the side of the fixed arm portion 153*b*. The resilient arm portion 153*a* is a type of doubly supported beam, the resilient contact portion 153*a*1 at or near the tip is elastically displaced in the long axis direction of the main body portion 111 (the lateral direction of the terminal receiving opening 154) by the elastic deformation of the resilient arm portion 153*a*. Also, the position on the side edge of the fixed arm portion 153*b* facing the resilient contact portion 153*a*1 has a rigid contact portion 153*b*1, and this rigid contact portion 153*b*1 is formed in a shape which is linear with respect to the side edge of the fixed arm portion 153*b*.

In the example shown in FIG. 7(*f*), the terminal receiving opening 154 includes an inner opening 154*a* formed between the resilient arm portion 153*a* and the fixed arm portion 153*b*, and an outer opening 154*b* formed to the outside of the resilient arm portion 153*a*. When a receiving terminal 153 is mated with a protruding terminal 53 on the male connector 1, the inner opening 154*a* is the portion receiving the protruding terminal 53, and the outer opening 154*b* is the portion allowing for displacement of the resilient arm portion 153*a*. The rest of the configuration and operation of the example shown in FIG. 7(*f*) is similar to the example shown in FIG. 7(*e*), so further explanation has been omitted.

When mating a male connector 1 and a female connector 101 with these configurations, in the male connector 1, the tail portions 58 of the conductive patterns 51 are connected using solder to connecting pads formed on the surface of a first board, and a portion of the bottom faces of the reinforcing brackets 56 is connected using solder to fixing pads formed on the surface of the first board. In this way, the connector is mounted on the surface of the first board. In the female connector 101, the tail portions 158 of the conductive patterns 151 are connected using solder to connecting pads formed on the surface of the second board, and a portion of the bottom faces of the reinforcing brackets 156 is connected using solder to fixing pads formed on the surface of the second board. In this way, the connector is mounted on the surface of the second board. In order to simplify the explanation, the first board and second board have been omitted from FIGS. 8-9.

Figure 8A:
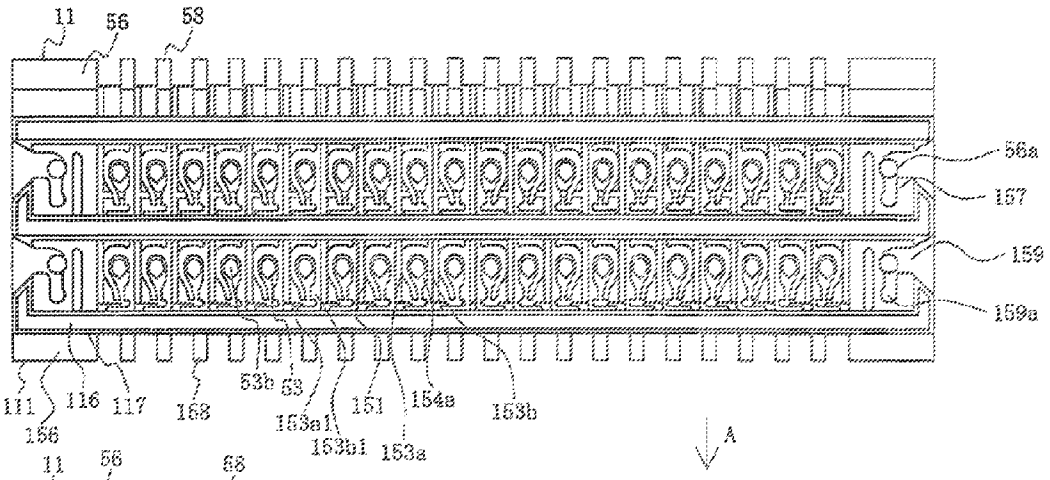
FIG. 8 is a first view showing the mating operation for the first connector of FIG. 1 and the second connector of FIG. 2, in which FIG. 8(*a*) is a top view from the mounted face side of the second connector and FIG. 8 *b*) is a transverse cross-sectional view of the side face of the protruding terminals in FIG. 8(*a*)
Figure 8B:
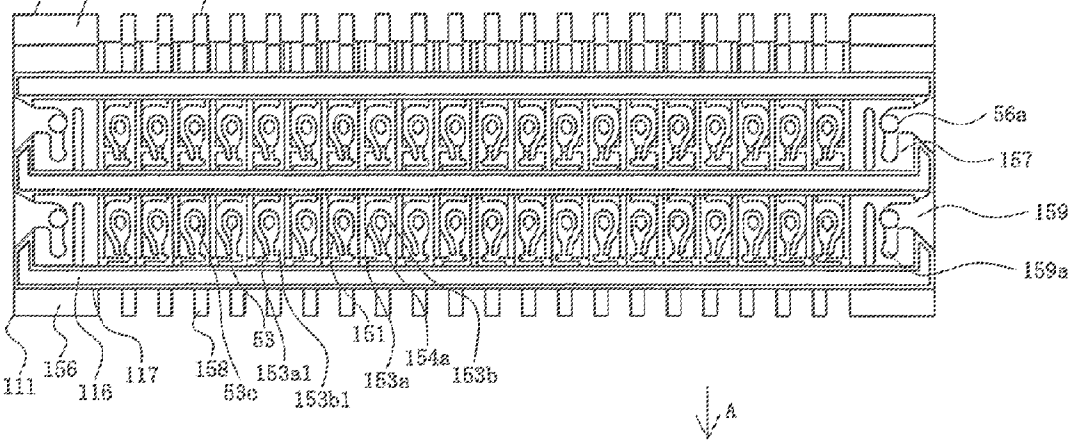

The operator lowers the male connector 1 towards the female connector 101 in the mating direction with the mated face of the male connector 1 and the mated face of the female connector 101 facing each other, and the mated face of the male connector 1 is brought into contact or close to contact with the mated face of the female connector 101. This results in the state shown in FIGS. 8(*a*)-(*b*). Here, the engaging protrusions 56*a* formed in the left and right reinforcing brackets 56 of the male connector 1 enter the engaging openings 159 formed in the left and right reinforcing brackets 156 of the female connector 101, and the male connector 1 and the female connector 101 are positioned in the lateral direction. Also, each protruding terminal 53 enters an inner opening 154*a* formed between the resilient arm portion 153*a* and the fixed arm portion 153*b* inside the corresponding receiving terminal 153. As shown in FIG. 8(*a*), the dimension of the inner portion of the curved portion 153*a*2 of the inner opening 154*a* is greater than the outer dimension of the tip portion 53*b* of the protruding terminal 53, which enables the protruding terminal 53 to smoothly enter the inner opening 154*a*.

Next, the operator slides the male connector 1 forward with respect to the female connector 101 as indicated by arrow A in FIGS. 8(*a*)-(*b*). In other words, the male connector 1 is advanced in the forward direction relative to the female connector 101 with the surface of the male connector 1 and the surface of the female connector 101 making contact or approaching each other. Because each protruding terminal 53 smoothly enters the inner opening 154*a* on the inside of the corresponding receiving terminal 153, and because the left and right engaging protruding portions 56*a* smoothly enter the left and right engaging openings 159, the male connector 1 is not misaligned relative to the female connector 101.

Figure 9A:
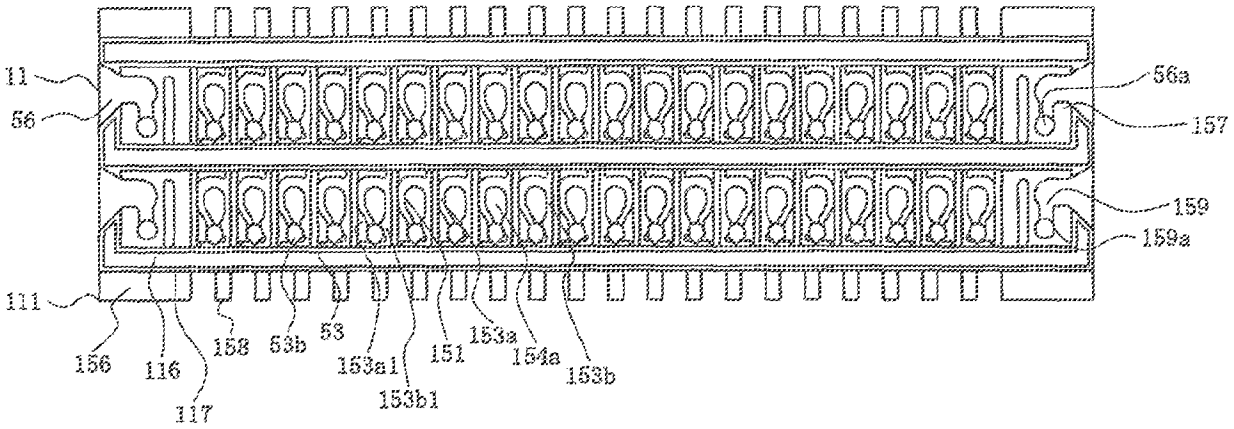
FIG. 9 is a second view showing the mating operation for the first connector of FIG. 1 and the second connector of FIG. 2, in which FIG. 9(*a*) is a top view from the mounted face side of the second connector and FIG. 9(*b*) is a transverse cross-sectional view of the side face of the protruding terminals in FIG. 9(*a*)
Figure 9B:
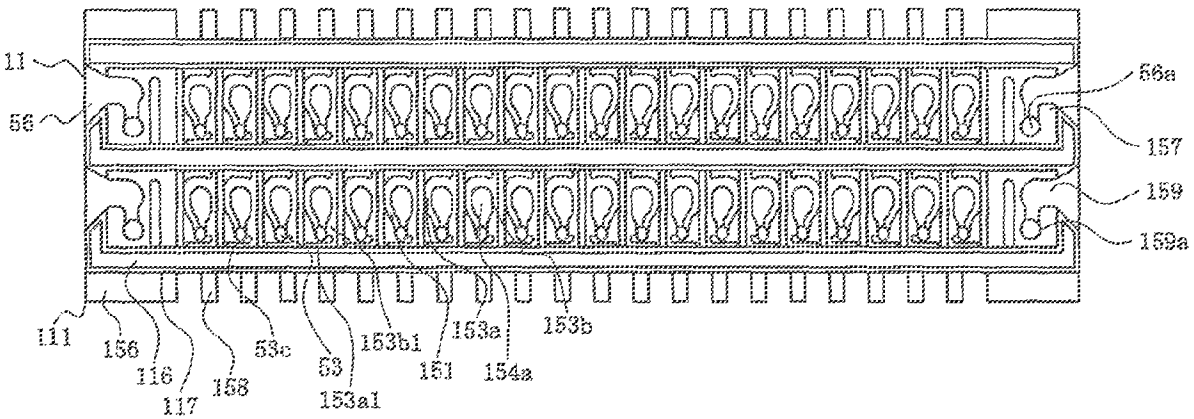
Figure 10:
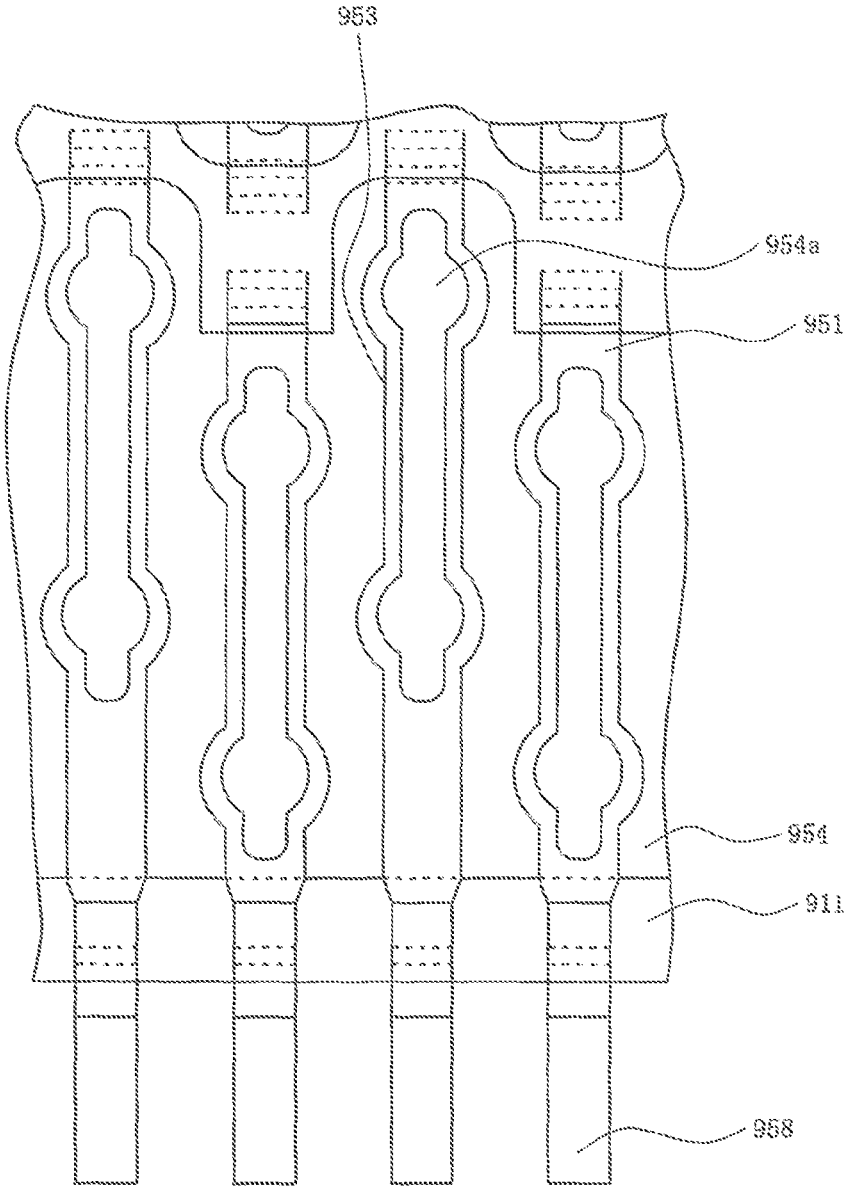
FIG. 10 PRIOR ART
FIG. 10 is a top view of a conventional connector.

As shown in FIGS. 9(*a*)-(*b*), when the mating of the male connector 1 and the female connector 101 has been completed, each protruding terminal 53 has entered the portion between the resilient contact portion 153*a*1 and the rigid contact portion 153*b*1 in the corresponding receiving terminal 153. In each receiving terminal 153, the interval between the resilient contact portion 153*a*1 and the rigid contact portion 153*b* makes contact with the side portion 53*c* of the protruding terminal 53 and is pushed apart. The spring action of the resilient arm portion 153*a* pushes the resilient contact arm portion 153*a*1 against the side portion 53*c* of the protruding terminal 53, and the side portion 53*c* of the protruding terminal 53 is elastically pinched between the resilient contact portion 153*a*1 and the rigid contact portion 153*b*1. In this way, reliable contact and an electrical connection are established between the protruding terminal 53 and the corresponding received terminal 153.

When the protruding terminal 53 enters the portion between the resilient contact portion 153*a*1 and the rigid contact portion 153*b*1, only one side portion 53*c* (left or right) sustains force or contact pressure from the resilient arm portion 153*a*. However, as mentioned above, because the contact pressure generated by the resilient arm portion 153*a* in each receiving terminal 153 occurs towards the center in the lateral direction of the female connector 101, the male connector 1 and the female connector 101 remain stable.

Also, when a protruding terminal 53 enters the portion between a resilient contact portion 153*a*1 and a rigid contact portion 153*b*1, it rides up over the rigid contact portion 153*b*1 protruding from the side edge of the fixed arm portion 153*b*, and sustains rebounding force. This rebounding force is transmitted to the finger of the operator as a clicking sensation. In other words, a clicking sensation is generated by the side portion 53*c* of the protruding terminal 53 riding up over the rigid contact portion 153*b*1.

When the transverse cross-sectional shape of the side portion 53*c* of the protruding terminal 53 is larger in the longitudinal direction than in the lateral direction, the contact area between the resilient contact portion 153*a*1 and the rigid contact portion 153*b*1 is increased, the contact resistance is reduced, and the terminal is stably pinched by the resilient contact portion 153*a*1 and the rigid contact portion 153*b*1. When the transverse cross-sectional shape of the side portion 53*c* of the protruding terminal 53 is pointed in the forward direction or has an inclined portion in the front, the terminal can more easily enter the portion between the resilient contact portion 153*a*1 and the rigid contact portion 153*b*1. As a result, the male connector 1 and the female connector 101 can be more easily mated.

As shown in FIGS. 9(*a*)-(*b*), when the mating of the male connector 1 and female connector 101 has been completed, the engaging protruding portion 56*a* is held inside the holding portion 159*a*. In this way, the male connector 1 and the female connector 101 are more readily positioned.

The mated male connector 1 and female connector 101 can be disconnected by performing the same steps as the mating operation for the male connector 1 and the female connector 101 except in reverse, so further explanation has been omitted.

In the present embodiment, the female connector 101 mated with the male connector 1 has a plate-like conductive portion 150 including a plurality of conductive patterns 151, and each conductive pattern 151 includes receiving terminals 153 engaging the protruding terminals 53 of the male connector 1. Each receiving terminal 153 includes an inner opening 154*a* for receiving a protruding terminal 53, a beam-like resilient arm portion 153*a* positioned to the side of the fixed arm portion 153*b*, and a resilient contact portion 153*a*1 formed in the resilient arm portion 153*a*. When a protruding terminal 53 inside the inner opening 154*a* moves relative to the resilient contact portion 153*a*1, the resilient arm portion 153*a* generates spring force towards the center of the female connector 101 in the lateral direction. As a result, the receiving terminals 153 do not bulge to either side, and adjacent terminals 153 are unlikely to come into contact with each other, even when the pitch of the receiving terminal 153 is narrow. Also, contact between the receiving terminals 153 and the protruding terminals 53 can be stably maintained, and brief interruptions can be reliably prevented. Because the receiving terminals 153 are formed by patterning conductive patterns 151, the female connector 101 is easy to manufacture, the configuration is simple, and production costs are reduced. The resulting connector 101 is also compact and has a low profile.

The receiving terminal 153 in each conductive pattern 151 has an asymmetrical shape with respect to the centerline of the conductive pattern 151 in the lateral direction. Also, a plurality of conductive patterns 151 is formed in a row extending in the lateral direction of the female connector 101, and the receiving terminals 153 are arranged so as to be symmetrical with respect to the centerline of the female connector 101 in the lateral direction. In this way, the mated male connector 1 and female connector 101 remain stable, and contact is stably maintained between all of the protruding terminals 53 and receiving terminals 153.

In addition, each resilient arm portion 153*a* includes a curved portion 153*a*2, and the curved portion 153*a*2 is curved so as to bulge in the opposite direction of the center of the female connector 101 in the lateral direction. As a result, the resilient arm portions 153*a* can elastically displace the resilient contact portion 153*a*1 connected to the tip towards the center of the female connector 101 in the width direction.

When a protruding terminal 53 inside the inner portion of the curved portion 153*a*2 of the inner opening 154*a* moves relative to the resilient contact portion 153*a*1, the resilient arm portion 153*a* generates spring force towards the center of the female connector 101 in the lateral direction. Therefore, contact between the receiving terminals 153 and the protruding terminals 53 can be stably maintained, and the occurrence of brief interruptions reliably prevented.

Also, each plate-like terminal 153 includes a fixed arm portion 153*b* positioned to the side on the opposite side of the resilient arm portion 153*a* in the inner opening 154*a*, and a rigid contact portion 153*b*1 formed in the fixed arm portion 153*b* and facing the resilient contact portion 153*a*1. Here, at least one protruding terminal 53 is pinched by a resilient contact portion 153*a*1 and a rigid contact portion 153*b*1. Because at least one protruding terminal 53 is reliably pinched by a plate-like terminal 153, the mated male connector 1 and female connector 101 are reliably maintained.

Further, the resilient arm portions 153*a* in the receiving terminals 153 of the conductive patterns 151 arranged on the right side of the centerline of the female connector 101 in the lateral direction are positioned to the right of the inner opening 154*a*, and the resilient arm portions 153*a* in the receiving terminals 153 of the conductive patterns 151 arranged on the left side of the centerline of the female connector 101 in the lateral direction are positioned to the left of the inner opening 154*a*. Therefore, because the spring force generated by the resilient arm portions 153*a* of all of the receiving terminals 153 is towards the center of the female connector 101 in the lateral direction, stable contact is maintained between all of the protruding terminals 53 and receiving terminals 153.

The transverse cross-sectional shape of the protruding terminals 53 is greater in the longitudinal direction than in the lateral direction. As a result, the protruding terminals 53 remain stable, pinched on both sides by a resilient contact portion 153*a*1 and a rigid contact portion 153*b*1, and the contact remains reliable despite external shocks and vibrations.

While a preferred embodiment of the Present Disclosure is shown and described, it is envisioned that those skilled in the art may devise various modifications without departing from the spirit and scope of the foregoing Description and the appended Claims.

What is claimed is:

1. A connector having a plate-like conducting portion including a plurality of conductive patterns, and mated with another connector, each conductive pattern including a plate-like terminal which engages a protruding terminal on the other connector, the plate-like terminal comprising:

a protruding terminal receiving opening for receiving the protruding terminal;

a beam-like first terminal member positioned to the side of the protruding terminal receiving opening; and a first contact portion formed in the first terminal member;

wherein the first terminal member generates spring force towards the center of the connector in the lateral direction when the protruding terminal received inside the protruding terminal-receiving opening moves relative to the first contact portion.

2. The connector of claim 1, wherein the plate-like terminal has an asymmetrical shape relative to the centerline of each conductive pattern in the lateral direction.

3. The connector of claim 2, wherein the plurality of conductive patterns is formed in a row extending in the lateral direction of the conductor, the shape of the plate-like terminals being arranged so as to be symmetrical relative to the centerline of the conductor in the lateral direction.

4. The connector of claim 3, wherein the first terminal member includes a curved portion, the curved portion is curved to bow outward in the direction opposite the center of the connector in the lateral direction.

5. The connector of claim 4, wherein the first terminal member generates spring force towards the center of the connector in the lateral direction when the protruding terminal received inside the curved portion at the protruding terminal receiving opening moves relative to the first contact portion.

6. The connector of claim 5, wherein the plate-like terminal includes a second terminal member positioned on the opposite side of the first terminal member at the protruding terminal receiving opening, and a second contact portion formed in the second terminal portion facing the first contact portion, at least one of the protruding terminals being pinched between the first contact portion and the second contact portion.

7. The connector of claim 6, wherein the first terminal member in the plate-like terminal of the conductive pattern arranged on the right side of the centerline of the connector in the lateral direction is positioned to the right of the protruding terminal receiving opening.

8. The connector of claim 7, wherein the first terminal member in the plate-like terminal of the conductive pattern arranged on the left side of the centerline of the connector in the lateral direction is positioned to the left of the protruding terminal receiving opening.

9. The connector of claim 8, wherein the dimension of the transverse cross-sectional shape of the protruding terminal is greater in the lateral direction than in the longitudinal direction.

10. The connector according to claim 1, wherein the first terminal member includes a curved portion, the curved portion is curved to bow outward in the direction opposite the center of the connector in the lateral direction.

11. The connector of claim 10, wherein the first terminal member generates spring force towards the center of the connector in the lateral direction when the protruding terminal received inside the curved portion at the protruding terminal receiving opening moves relative to the first contact portion.

12. The connector of claim 11, wherein the dimension of the transverse cross-sectional shape of the protruding terminal is greater in the lateral direction than in the longitudinal direction.

13. The connector of claim 1, wherein the plate-like terminal includes a second terminal member positioned on the opposite side of the first terminal member at the protruding terminal receiving opening, and a second contact portion formed in the second terminal portion facing the first contact portion, at least one of the protruding terminals being pinched between the first contact portion and the second contact portion.

14. The connector of claim 13, wherein the dimension of the transverse cross-sectional shape of the protruding terminal is greater in the lateral direction than in the longitudinal direction.

15. The connector of claim 1, wherein the first terminal member in the plate-like terminal of the conductive pattern arranged on the right side of the centerline of the connector in the lateral direction is positioned to the right of the protruding terminal receiving opening.

16. The connector of claim 15, wherein the first terminal member in the plate-like terminal of the conductive pattern arranged on the left side of the centerline of the connector in the lateral direction is positioned to the left of the protruding terminal receiving opening.

17. The connector of claim 16, wherein the dimension of the transverse cross-sectional shape of the protruding terminal is greater in the lateral direction than in the longitudinal direction.

18. The connector of claim 1, wherein the dimension of the transverse cross-sectional shape of the protruding terminal is greater in the lateral direction than in the longitudinal direction.

* * * * *